US007919002B1

(12) United States Patent
Hurtado

(10) Patent No.: US 7,919,002 B1
(45) Date of Patent: Apr. 5, 2011

(54) DEBRIS TRAP AND METHOD OF TRAPPING DEBRIS

(76) Inventor: Jim Hurtado, Fanwood, NJ (US)

( * ) Notice: Subject to any disclaimer, the term of this patent is extended or adjusted under 35 U.S.C. 154(b) by 114 days.

(21) Appl. No.: 12/535,182

(22) Filed: Aug. 4, 2009

(51) Int. Cl.
*B01D 35/02* (2006.01)
*E04D 13/08* (2006.01)

(52) U.S. Cl. ... 210/747; 210/791; 210/162; 210/170.03; 210/447; 210/448; 210/452; 52/12; 52/16

(58) Field of Classification Search ..... 210/154, 210/162, 170.03, 446, 447, 448, 451, 452, 210/477, 747, 767, 791; 52/12, 16
See application file for complete search history.

(56) References Cited

U.S. PATENT DOCUMENTS

| | | | | | |
|---|---|---|---|---|---|
| 174,701 | A | | 3/1876 | Parker | |
| 289,473 | A | | 12/1883 | Van Tassel | |
| 527,400 | A | | 10/1894 | Barth | |
| 543,922 | A | | 8/1895 | Buckley | |
| 1,044,601 | A | | 11/1912 | Thiem | |
| 1,076,075 | A | | 10/1913 | Steele | |
| 1,653,473 | A | | 11/1925 | Schultz | |
| 2,494,780 | A | * | 1/1950 | Schmidt | 210/162 |
| 2,887,073 | A | | 5/1959 | Thompson | |
| 3,465,885 | A | * | 9/1969 | George | 210/447 |
| 3,628,668 | A | | 12/1971 | Huppert | |
| 4,798,028 | A | | 1/1989 | Pinion | |
| 4,801,377 | A | * | 1/1989 | Bolt | 210/162 |
| 5,114,594 | A | * | 5/1992 | Rosebrock et al. | 210/446 |
| 5,230,798 | A | * | 7/1993 | Rogman | 210/447 |
| 5,452,546 | A | * | 9/1995 | Goddard | 52/12 |
| 5,985,158 | A | | 11/1999 | Tiderington | |
| 6,705,049 | B2 | | 3/2004 | Esmond et al. | |
| 2008/0086953 | A1 | * | 4/2008 | Graf | 52/12 |

* cited by examiner

*Primary Examiner* — Christopher Upton
(74) *Attorney, Agent, or Firm* — Thomas L. Adams

(57) ABSTRACT

Most commercial & residential buildings have rainwater collection systems that consist of leaders and gutters that collect water coming off the roof. These leaders and gutters are connected to drain pipes that channel the water away from the structure, usually into a dry well or storm drain. A substantial add-on to the leader and gutter system is a debris trap with an overflow port. The debris trap/overflow port may be attached to the leader at waist height (for easy access) to collect leaves, tree droppings, windblown litter and other materials. This debris can be easily discarded by opening an access panel to empty a built-in strainer. When a dry well or storm drain becomes saturated, water will back up through the leader causing seepage and overflow into the building and create erosion that can damage the foundation. The function of the overflow port is to divert water from the drain pipe away from the foundation. The debris trap/overflow port system not only channels water away from the building but also prevents overflow of organic materials that can accumulate along the foundation.

23 Claims, 5 Drawing Sheets

DEBRIS TRAP AND METHOD OF TRAPPING DEBRIS

BACKGROUND OF THE INVENTION

1. Field of the Invention

The present invention relates to debris traps for leaders, and in particular; to traps having an overflow port 2. Description of Related Art Many building structures include rainwater collection systems comprised of gutters that drain into leaders. It is important to collect rainwater and divert it from a building to avoid seepage back into the building or erosion that can weaken the building's foundation.

In some cases the leaders may feed the rainwater through an underground irrigation-type pipe or through a regular drainage pipe into a dry well or storm drain. However, leaves, tree droppings, windblown litter, material carried by insects and small animals and other debris, whether carried by the rainwater or not, can land and a gutter and eventually enter the drainage system. Such debris can clog drainage pipes, dry wells and storm drains, causing backups, and possible damage to the drainage system and to the protected structures.

To avoid clogging, the gutters must be cleaned out frequently. Traditionally, this is an inconvenient and dangerous task which involves having someone climb up a ladder to the roof, or even onto the roof. However, even when the gutters are cleaned regularly, clogging may still occur because all debris may not be removed before it has the opportunity to enter the leader.

See also U.S. Pat. Nos. 174,701; 289,473; 527,400; 543,922; 1,044,601; 1,076,075; 1,653,473; 2,887,073; 3,628,668; 4,798,028; 5,985,158; and 6,705,049

SUMMARY OF THE INVENTION

In accordance with the illustrative embodiments demonstrating features and advantages of the present invention, there is provided a debris trap for a leader from a gutter on a building. The trap has a hollow body with an access opening and a cover for covering the access opening. The body has a lower compartment and an upper chamber. The upper chamber communicates from above with an upper leader inlet adapted to couple to the leader. The lower compartment has a lower outlet and an overflow port above the lower outlet. The trap also has a strainer sized to be mounted inside the upper chamber above the lower compartment.

In accordance with another aspect of the invention a method is provided for trapping debris flowing through a leader from a gutter on a building. The method employs a strainer and a hollow body having a normally covered access opening, an upper leader inlet, a lower outlet and an overflow port above the lower outlet. The method includes the step of connecting the leader to the upper leader inlet and the lower outlet to a drainage pipe. Another step is mounting the strainer above the overflow port to trap the debris from the leader, as well as covering the access opening. The method includes the step of permitting water to overflow through the overflow port when water in the drain pipe backs up.

In accordance with yet another aspect of the invention a debris trap is provided for a leader from a gutter on a building. The trap has a hollow body with a pear shaped access opening and a cover with a pear-shaped periphery for covering the access opening. The access opening has a peripheral shelf for receiving the cover. The body has a lower compartment and an upper chamber. The upper chamber has an overall width exceeding that of the lower compartment. The outside of the upper chamber is at least partially pear shaped. The upper chamber communicates from above with an upper leader inlet adapted to couple to the leader. The leader inlet has a tapered female fitting. The lower compartment has a downwardly directed lower outlet and an overflow port above the lower outlet. The overflow port has a front conduit oriented to discharge in front of the trap at an acute angle from the compartment. The lower outlet includes a cylindrical female fitting. The hollow body has an upper pair of mounting flanges and a lower pair of mounting flanges. The upper and lower pairs are separately mounted at either end of the upper chamber. The trap also has a strainer sized to be mounted inside the upper chamber above the lower compartment and still be removable through the access opening. The strainer has a back and a front. The back has an overall height exceeding the central height in the front of the strainer. The access opening extends without descending below the front of the strainer. The strainer includes a lower grate subjacently encircled by a converging guide fence.

By employing apparatus or methods of the foregoing type an improved technique is achieved for trapping debris traveling through a leader or the like. In a disclosed embodiment a relatively large upper chamber has an upper inlet. This upper inlet is tapered so that a leader can be sealingly pressed into the inlet. The bottom of this upper chamber has a receptacle for holding a removable strainer.

The disclosed strainer is made of a mesh arranged with a flat back wall integral with a bowl-shaped front section. The floor of the strainer has an opening bordered by dependent walls forming a funnel-like guide fence. A number of louver rods forming a grating are mounted at the top of the fence. Thus, this grating and the mesh of the strainer will capture debris falling down through the upper chamber.

This converging fence fits into a tapered mouth that leads to a lower compartment. This lower compartment branches into a vertical outlet pipe and into an overflow spout angled downwardly at an acute angle to the vertical pipe. This vertical outlet pipe can feed an irrigation pipe, a dry well, or the like With this arrangement debris carried by rainwater through a leader to the upper chamber will be captured in the strainer. By removing a cover on the upper chamber the captured debris can be periodically removed either directly by hand or by removing the strainer and cleaning it.

In some cases water that should flow through the vertical outlet pipe will back up. In that case the backed up water will tend to flow through the lower compartment and out the overflow spout. Because the spout is below the strainer, the trap has an overflow port that tends to prevent water from backing up into the strainer.

Avoiding a backflow into the strainer prevents reverse movement of debris upstream through the upper chamber or back through its leader. Such reverse upstream flow might cause clogging at locations that are not readily accessible. Also, backflow can cause agitation that might break the debris into smaller particles that are more difficult to clear or that may then bypass the strainer.

BRIEF DESCRIPTION OF THE DRAWINGS

The above brief description as well as other objects, features and advantages of the present invention will be more fully appreciated by reference to the following detailed description of illustrative embodiments in accordance with the present invention when taken in conjunction with the accompanying drawings, wherein.

DETAILED DESCRIPTION OF THE PREFERRED EMBODIMENTS

Figure 1:
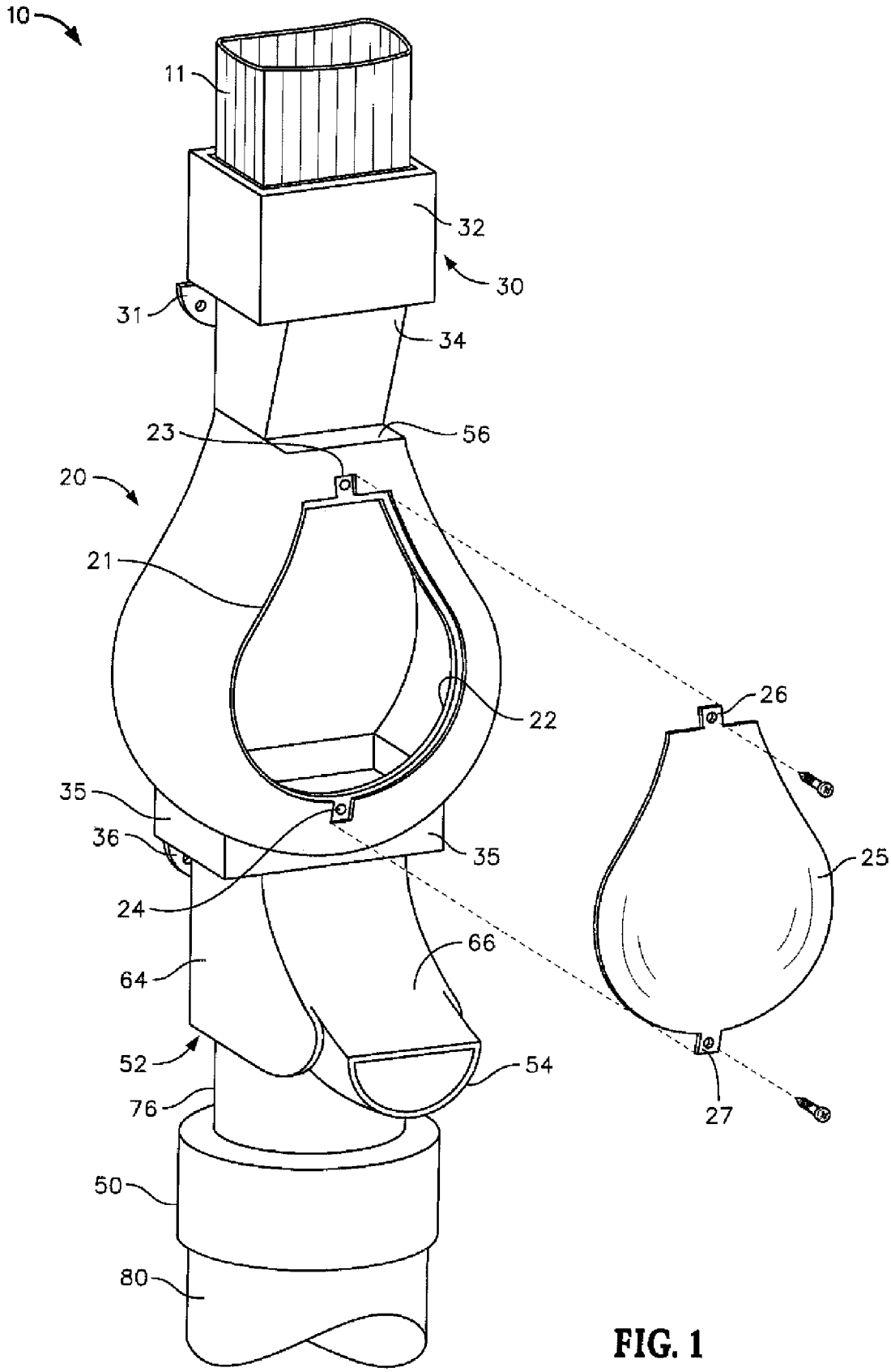
FIG. 1 is a perspective view of a debris trap without a strainer and with its cover removed, in accordance with principles of the present invention.

Referring to FIGS. 1 and 3-5, a debris trap 10 is shown having an upper leader inlet 30, upper chamber 20, and lower compartment 52. Upper chamber 20 has an overall width that exceeds that of lower compartment 52. The leader trap 10 is made from a rust resistant material such as aluminum, copper, galvanized steel or vinyl. In one embodiment debris trap 10 is an integral unit, injection molded from thermoplastic.

A leader 11 from a gutter on a building is placed inside the upper leader inlet 30 of the debris trap 10. The inlet 30 is a tapered female fitting which is comprised of two sections. The upper section 32 of the inlet is a rectangular tube sized to receive leader 11 and has front and side walls that overhang lower section 34. As an option for some embodiments, some or all of the walls of section 32 will thicken in a downward direction to provide internal tapering.

The internal passage of section 34 is tapered and smaller than that of section 32. This tapering is accomplished with a back wall (and optionally side walls) that thickens in a downward direction, and a front wall with a uniform thickness but tilted to accomplished the downward tapering. The outside surfaces of the back and side walls of lower section 34 are joined at right angles and are parallel to the axis of upper section 32. Leader 11 passes through upper section 32 and is then compressed as it is jammed into tapered lower section 34, to provide a substantially leak-free seal.

The upper chamber 20 of the trap 10 has a flat back and is otherwise a partially pear-shaped, hollow body. The internal volume of upper chamber 20 is relatively large, providing a substantial capacity for collecting debris. The top of chamber 20 communicates with section 34 except for flat ledge 56, which extends outwardly a from the lower front edge of section 34. The top of chamber 20 has the same width as section 34 but a greater depth (front to back dimension).

On the front of upper chamber 20 is an access opening 21 with a pear-shaped periphery. Projecting inwardly from the rim of opening 21 is a peripheral shelf 22, which can receive a cover 25 to close the access opening 21. Cover 25 will be slightly domed to blend smoothly with the pear shape of upper chamber 20. Shelf 22 leads into an upper rectangular alcove 23 located at the center of the top straight portion of shelf 22. Directly below alcove 23 at the nadir of opening 21, shelf 22 leads into a lower rectangular alcove 24. Alcoves 23 and 24 are both shown with a screw hole.

Figure 3:
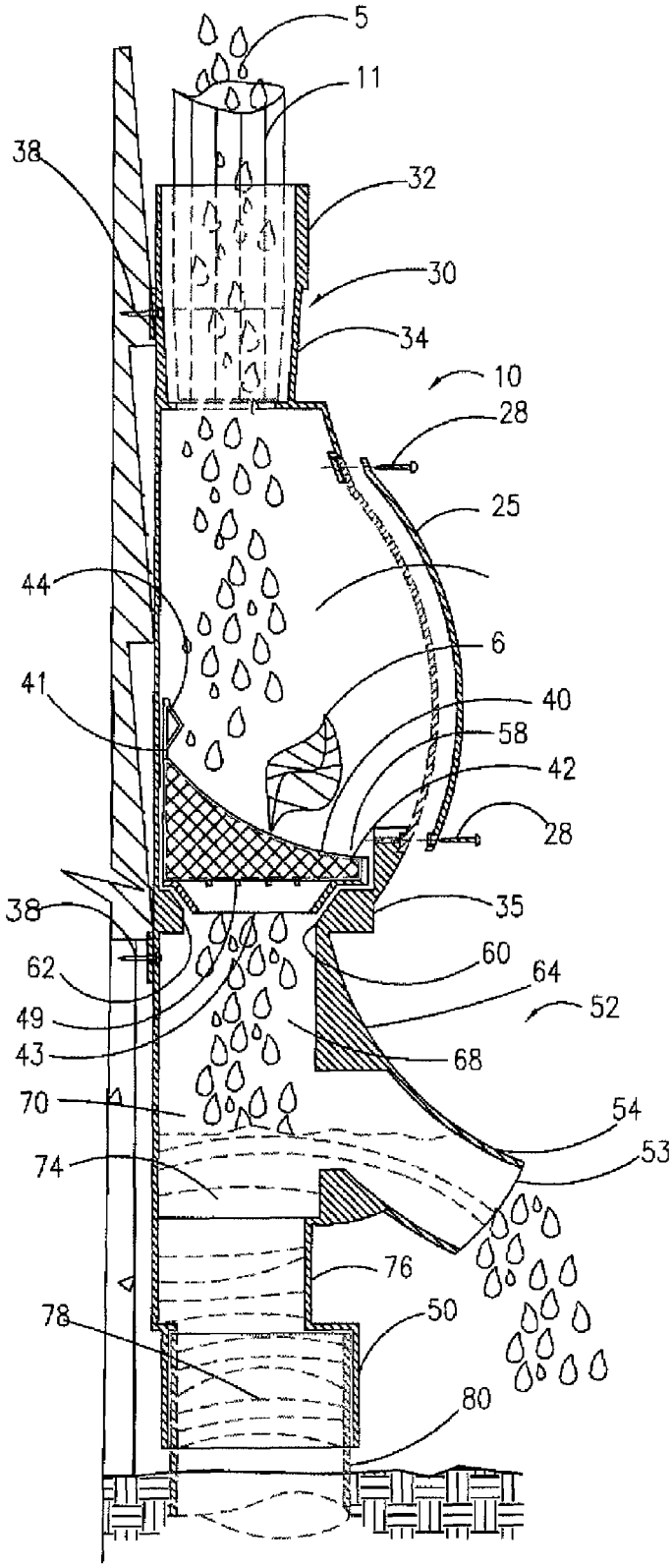
FIG. 3 is a side elevational view of the debris trap of FIG. 1, sectioned vertically.

Cover 25 is shaped to fit closely into access opening 21 and rest on shelf 22. The thickness of cover 25 matches the distance from the peripheral shelf 22 to the outer surface of upper chamber 20. An upper wing 26 and a lower wing 27 with central screw holes are integrally formed in the cover to fit into alcoves 23 and 24. As shown in FIG. 3, screws 28 may be threaded through the screw holes in wings 26 and 27 and into the screw holes in alcoves 23 and 24 to secure cover 25 to the upper chamber 20.

The bottom of chamber 20 distends inwardly at the front and sides to form an internal receptacle 58 encompassed by walls that are curved except for a flat wall in back. Receptacle 58 descends partially into rectangular base 35 before reaching a smaller tapered mouth 60 funneling into rectangular outlet 62 in base 35.

Below base 35 is previously mentioned lower compartment 52 of debris trap 10. The lower compartment 52 has a hollow, branched section 64 with a flat back and saddle-shaped front 66. The distal portions of the sides of section 64 are rounded somewhat into a pair of slightly protruding cheeks. The distal portion of front 66 is formed into a downwardly sloped spout 54 providing a front conduit 53 having a D-shaped cross section (D rotated clockwise 90°). Spout 54 serves as an overflow port when water backs up into trap 10.

The front wall of the upper half of section 64 distends inwardly to form a substantially rectangular passage 68 communicating with rectangular outlet 62. Passage 68 is larger than outlet 62 and extends transversely past the borders of outlet 62 except in front where passages 62 and 68 have coplanar walls. The distention ends at forked region 70 which communicates with oblique conduit 53 and rectangular vertical passage 74 in section 64.

Passage 74 communicates with integral pipe 76, which has walls of uniform thickness with a D-shaped cross section (the flat side facing backwardly). Pipe 76 communicates with a relatively larger fitting 50 whose external outline provides a D-shaped cross section (flat facing back) encompassing a cylindrical passage 78. Accordingly, fitting 50 operates as a lower outlet offering a cylindrical female fitting. The lower outlet 50 is downwardly directed and connects to a drainage pipe 80. Conduit 54 discharges at an acute angle relative to outlet 50.

Figure 4:
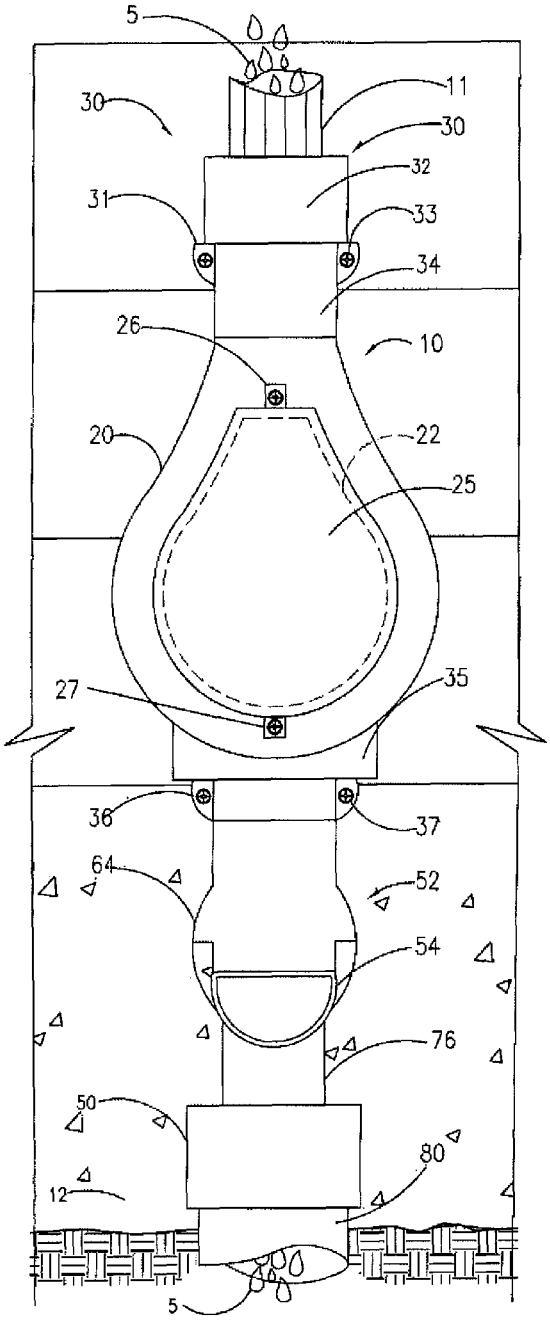
FIG. 4 is a front elevational view of the debris trap of FIG. 3.
Figure 5:
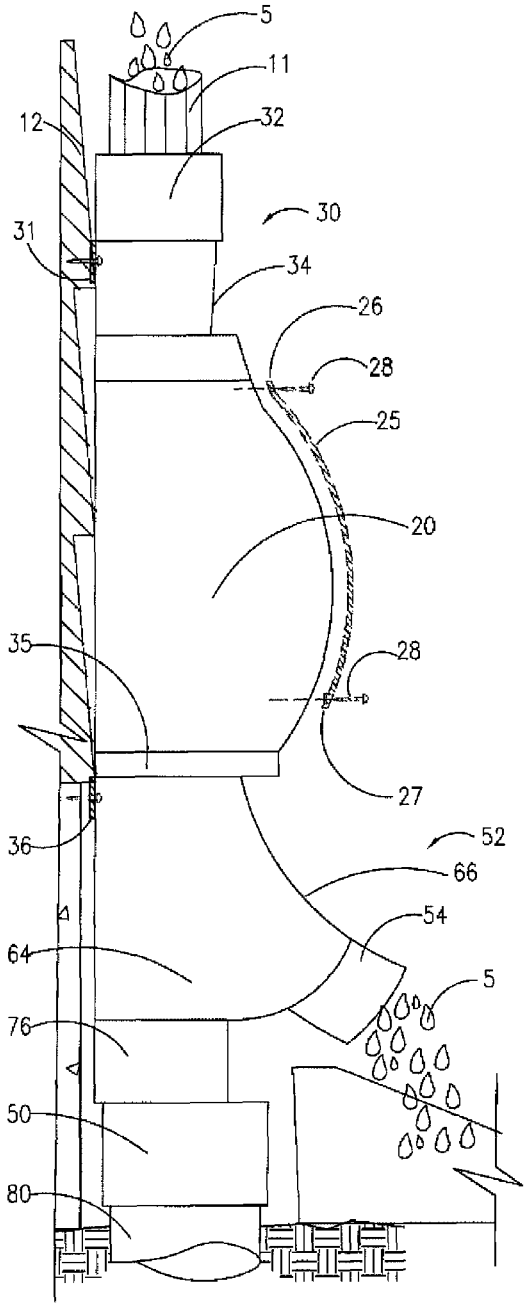
FIG. 5 is a side elevational view of the debris trap of FIG. 4.

Referring to FIG. 4, the upper chamber includes an upper pair 31, 33 and a lower pair 36, 37 of mounting flanges with fastener holes, each coplanar with the back of trap 10. The upper pair 31, a 33 is mounted on each side of the upper inlet 30 just below the upper section 32. The lower pair 36, and 37 is mounted on each side of the upper chamber 20 just below the base 35.

Figure 2:
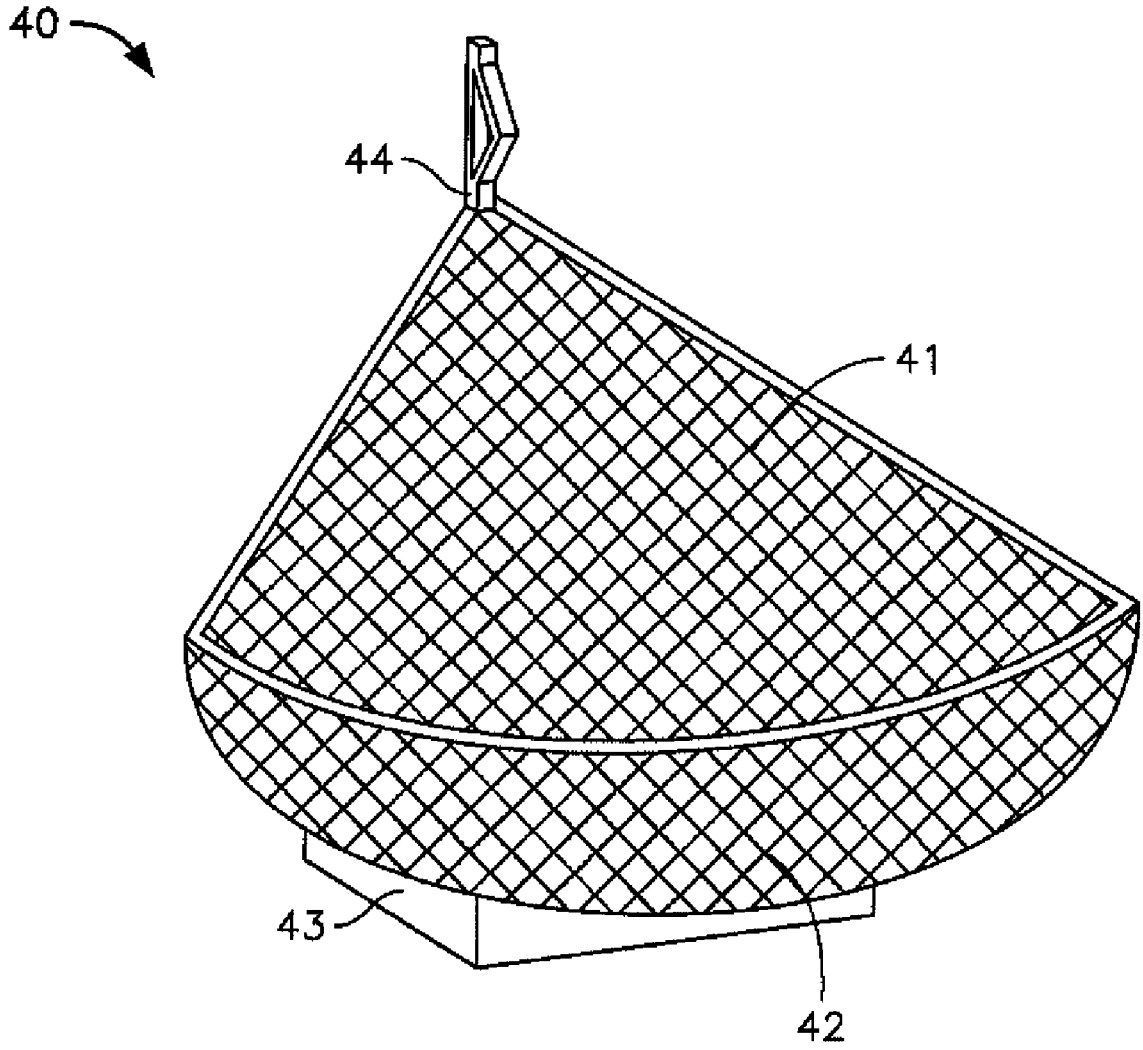
FIG. 2 is a perspective view of a strainer adapted for mounting in the trap of FIG. 1.

Referring to FIGS. 2 and 3, strainer 40 is formed with a common screening material made of aluminum, fiberglass, nylon, polyester, or the like. Strainer 40 is bowl-shaped except for a flat back portion 41, which is bordered by vertical side edges, a convex bottom edge, and a top edge with an inverted V shape. Bowl-shaped portion 42 in front of flat back 41 has a rim that slopes downwardly from flat back 41 to a nadir centered in front. Thus, the overall height of the back portion 41 exceeds the central height at this nadir of the front portion 42 of the strainer 40 (height being used in the sense of elevation of the rim).

Strainer 40 also includes a handle 44 at the peak of its back portion 41 to assist the user in removing and replacing the strainer 40 in the upper chamber 20. The handle 44 is metal band encompassing a triangular finger opening.

The floor of bowl-shaped portion 42 has a rectangular opening coinciding with the upper edges of the four walls of four-sided fence 43, each wall being a trapezoidal panel joined to form a funnel-like, converging guide fence. In this embodiment fence 43 is die-formed from aluminum with flanges that are secured to the bottom of bowl-shaped portion 42 by tack welding, glue, crimping, or any other durable method. Louver bars 49 are attached to the fence 43 across its upper, rectangular opening, creating a lower grate. Alternatively, grate 49 may be configured as a stand-alone unit and constructed so that it can be dropped into the bottom opening in bowl-shaped portion 42.

The strainer 40 is sized so that it can be removed for cleaning, and then replaced inside the leader trap 10 through the access opening 21. As shown in FIG. 3, when the strainer 40 is in position inside the upper chamber 20, the converging fence 43 extending downward through mouth 60 into base 35.

Figure 6:
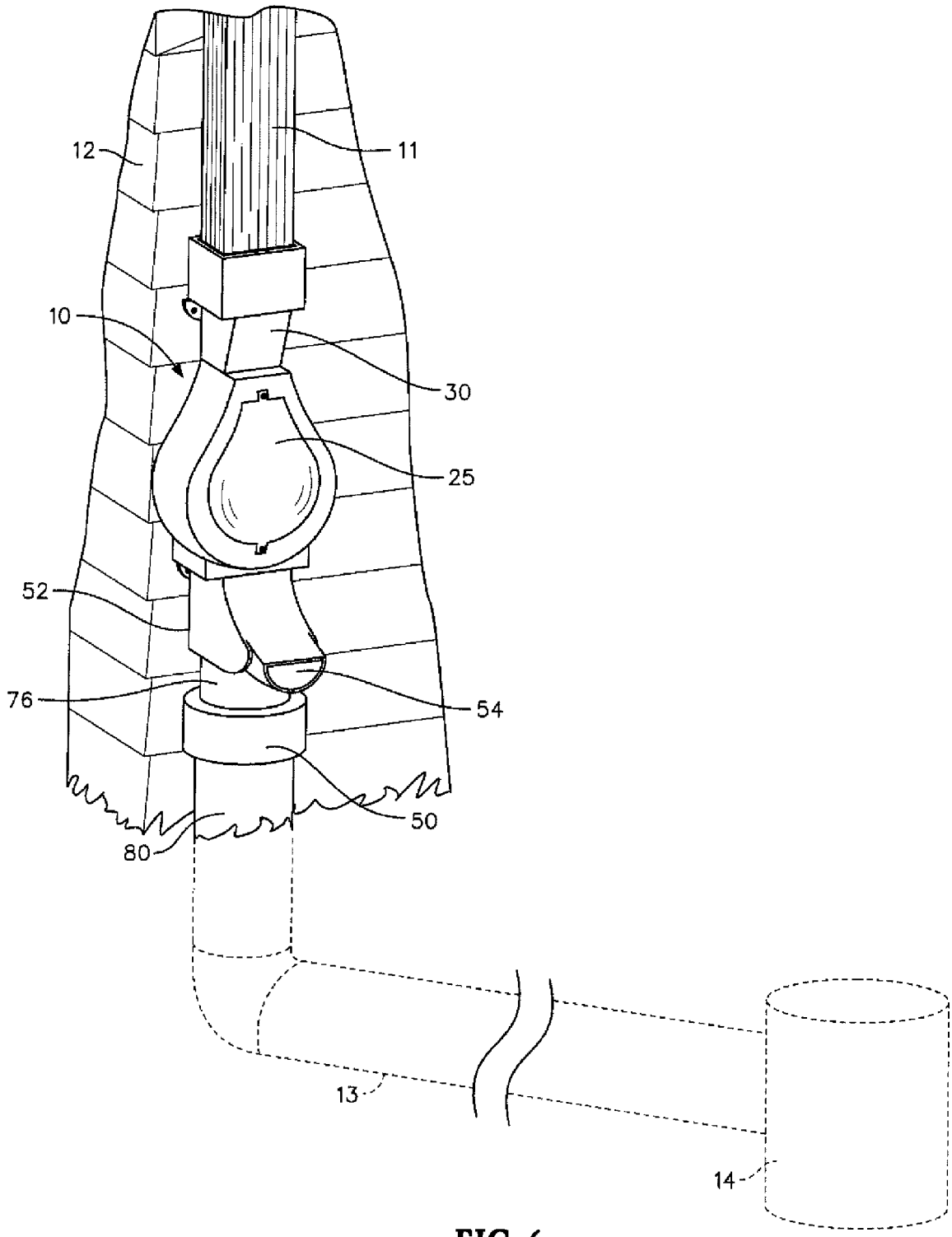
FIG. 6 is a perspective view of the trap of FIG. 1 installed on a building and connected through a drainage pipe to a dry well.

To facilitate an understanding of the principles associated with the foregoing apparatus, its operation will be briefly described in connection with FIGS. 1-6. Referring to FIG. 3, galvanized screws 38 may be used to mount the leader trap 10 to a building 12 through the mounting flanges 31, 33, 36, and 37. FIG. 6 shows the leader trap 10 connected to a leader 11 approximately 3 feet above the ground.

Rainwater 5 flows through the gutters (not shown) of building 12 into a leader 11. The leader 11 is connected to the upper inlet 30. As the leader 11 is force fit into lower section 34 of inlet 30, the flow of the rainwater 5 enters trap 10 without leaking.

Rainwater 5 then flows from leader 11 through leader inlet 30 into upper chamber 20. As rainwater 5 flows through the strainer 40, any debris 6 (leaves, pebbles, etc.) that may be flowing with rainwater 5 is trapped in the strainer. Therefore, the debris 6 remains in the upper chamber 20 and is not permitted to enter lower compartment 52.

The strained rainwater 5 continues to flow into the lower compartment 52 and through lower outlet 50. There the rainwater 5 flows into outlet pipe 80, which connects underground to drainage pipe 13. Pipe 13 is pitched downwardly and drains into underground dry well 14.

If pipe 13 and dry well 14 cannot accommodate the water flowing into trap 10, water will back up into the lower compartment 52. This backup may occur either because pipe 13 and dry well 14 have insufficient capacity or are clogged or broken. In this case, overflow port 54 is provided to allow the rainwater 5 to discharge at an acute angle directly onto the ground (in some cases onto an optional splash block (not shown)) away from the building 12.

It will be noted that because overflow conduit 54 is below strainer 40, water will not tend to backup into the strainer but will instead be quickly discharged through conduit 54. Avoiding a backflow into the strainer 40 prevents movement of debris 6 upstream into inlet 30 or leader 11, which might cause clogging at locations that are not readily accessible. Also, backflow can cause agitation that might break the debris into smaller particles that are more difficult to clear or that may bypass the strainer.

Since all debris 6 is trapped by strainer 40, its is necessary for a user to occasionally clear out upper chamber 20. To do so, the user removes screws 28 that are holding the cover 25 on access opening 21. Once cover 25 is removed, the user can manually remove any debris 6 inside the upper chamber 20. In addition, the user can grasp handle 44 of strainer 40 and remove it through access opening 21. After discarding any remaining debris 6, the clean strainer 40 can be replaced inside the upper chamber 20 with fence 43 inside mouth 60 (FIG. 3). Then, cover 25 can be put in place on shelf 22 of access opening 21 with wings 26 and 27 in alcoves 23 and 24 before reinstalling screws 28.

It is appreciated that various modifications may be implemented with respect to the above described embodiments. For example, the leader trap 10 may be constructed as a single unit or may be molded in multiple sections that would later be fastened together. Instead of having a pear-shaped upper chamber, the trap can have a shape that overall is rectangular, spherical, cylindrical, polyhedral, etc. While an acutely angled spout is shown as a overflow port, some embodiments may have a simple fitting to which a pipe or flexible hose can be connected to carry overflowing water away from the building. In some embodiments the overflow spout will swivel to allow the user to adjust the elevational and azimuthal angle of discharge. The disclosed strainer can have a variety of shapes including simple shapes such as a cylindrical or rectangular basket. In some embodiments the access opening can be on the side, and can have any one of a variety of outlines such as rectangular, circular, oval, polygonal, etc. Also, in some embodiments, the strainer may be built in (non-removable) so the user will simply remove trapped debris manually. The cover for the access opening can be hinged, can snap into place, can slide into position on channels, or can be held in place with any one of a variety of fasteners. Also, the size and capacity of the debris trap can vary depending upon the expected volume of water flow and the anticipated amount of debris.

Obviously, many modifications and variations of the present invention are possible in light of the above teachings. It is therefore to be understood that within the scope of the appended claims, the invention may be practiced otherwise than as specifically described.

The invention claimed is:

1. A debris trap for a leader from a gutter on a building, comprising:

a hollow body having an access opening and a cover for covering said access opening, said body having a lower compartment and an upper chamber, said upper chamber communicating from above with an upper leader inlet adapted to couple to said leader, said lower compartment having, a lower outlet and an overflow port above said lower outlet; and a strainer sized to be mounted inside said upper chamber above said lower compartment.

2. A debris trap according to claim 1 wherein said leader inlet comprises a tapered female fitting.

3. A debris trap according to claim 1 wherein said lower outlet is downwardly directed.

4. A debris trap according to claim 3 wherein said lower outlet comprises a cylindrical female fitting.

5. A debris trap according to claim 1 wherein said trap has a front, said overflow port oriented to discharge in front of said trap.

6. A debris trap according to claim 1 wherein said overflow port has a conduit oriented discharge at an acute angle relative to the lower outlet of said lower compartment.

7. A debris trap according to claim 1 wherein said upper chamber has an overall width exceeding that of said lower compartment.

8. A debris trap according to claim 7 wherein the outside of said upper chamber is at least partially pear shaped.

9. A debris trap according to claim 8 comprising an upper pair of mounting flanges and a lower pair of mounting flanges, the upper and lower pairs being separately mounted at either end of said upper chamber.

10. A debris trap according to claim 1 wherein said access opening has a peripheral shelf for receiving said cover.

11. A debris trap according to claim 1 wherein said access opening has a pear-shaped periphery.

12. A debris trap according to claim 1 wherein said strainer is sized to be removable from said upper chamber through said access opening.

13. A debris trap according to claim 1 wherein said strainer has a back and a front, said back having an overall height exceeding the central height in the front of said strainer.

14. A debris trap according to claim 13 wherein said access opening does not descend below the front of said strainer.

15. A debris trap according to claim 13 wherein said strainer comprises:

a lower grate subjacently encircled by a converging guide fence.

16. A method for trapping debris flowing through a leader from a gutter on a building, the method employing a strainer and a hollow body having a normally covered access opening, an upper leader inlet, a lower outlet and an overflow port above said lower outlet, the method including the steps of:

connecting the leader to the upper leader inlet and the lower outlet to a drainage pipe;

mounting the strainer above the overflow port to trap the debris from the leader and covering the access opening; and permitting water to overflow through the overflow port when water in the drain pipe backs up.

17. A method according to claim 16 wherein said overflow port is sized to prevent water from backing up to the strainer.

18. A method according to claim 16 wherein said hollow body is arranged to allow the overflow port to discharge freely to the ground.

19. A method according to claim 16 comprising the step of:

connecting the lower outlet through a drain pipe to a dry well.

20. A method according to claim 16 comprising the step of:

periodically uncovering the access opening and cleaning debris from the strainer.

21. A method according to claim 20 wherein the step of cleaning debris is performed by manually removing debris while the strainer remains inside the hollow body.

22. A method according to claim 20 wherein the step of cleaning debris is performed by removing debris after the strainer is removed from the hollow body.

23. A debris trap for a leader from a gutter on a building, comprising:

a hollow body having a pear shaped access opening and a cover with a pear-shaped periphery for covering said access opening, said access opening having a peripheral shelf for receiving said cover, said body having a lower compartment and an upper chamber, said upper chamber having an overall width exceeding that of said lower compartment, the outside of said upper chamber being at least partially pear shaped, said upper chamber communicating from above with an upper leader inlet adapted to couple to said leader, said leader inlet having a tapered female fitting, said lower compartment having a downwardly directed lower outlet and an overflow port above said lower outlet, said overflow port having a front conduit oriented to discharge in front of said trap at an acute angle from said compartment, said lower outlet including a cylindrical female fitting, said hollow body having an upper pair of mounting flanges and a lower pair of mounting flanges, the upper and lower pairs being separately mounted at either end of said upper chamber; and a strainer sized to be mounted inside said upper chamber above said lower compartment and still be removable through said access opening, said strainer having a back and a front, said back having an overall height exceeding the central height in the front of said strainer, said access opening extending without descending below the front of said strainer, said strainer including a lower grate subjacently encircled by a converging guide fence.

* * * * *